US005141414A

United States Patent [19]

Pierce et al.

[11] Patent Number: 5,141,414

[45] Date of Patent: Aug. 25, 1992

[54] PISTON PUMP FOR EASILY DAMAGED PRODUCTS

[75] Inventors: Christopher R. Pierce, Oakland, Calif.; Richard W. Dorr, Lockport, Ill.

[73] Assignee: Beacon Enterprises, Inc., Chicago, Ill.

[21] Appl. No.: 646,090

[22] Filed: Jan. 25, 1991

[51] Int. Cl.[5] ..... F04B 21/02

[52] U.S. Cl. ..... 417/532; 417/430; 417/516; 417/519; 417/489

[58] Field of Search ..... 417/900, 430, 516, 532, 417/515, 461, 467, 489, 519

[56] References Cited

U.S. PATENT DOCUMENTS

| | | | |
|---|---|---|---|
| 2,516,388 | 7/1950 | Humphreys | 417/519 |
| 3,035,527 | 2/1960 | Langemack | 417/461 |
| 3,266,433 | 8/1966 | Mason | 417/900 |
| 3,876,341 | 4/1975 | Nesseth | 417/900 |
| 4,102,613 | 7/1978 | Vukich | 417/516 |
| 4,533,300 | 8/1985 | Westerlund et al. | 417/339 |

FOREIGN PATENT DOCUMENTS

| | | | |
|---|---|---|---|
| 89040 | 4/1937 | Sweden | 417/461 |

*Primary Examiner*—Richard A. Bertsch
*Assistant Examiner*—Charles G. Freay
*Attorney, Agent, or Firm*—McAndrews, Held & Malloy, Ltd.

[57] ABSTRACT

An improved pumping device for delicate or easily damaged products is provided with a hopper, or other system for holding the products, and at least one, and preferably two, synchronized piston pumps positioned proximate to the bottom of the hopper. The piston pumps displace the product from the interior of the hopper into a consolidating feed manifold where the product is then dispensed through a discharge conduit into suitable receptacles. Each of the piston pumps preferably includes a pump cylinder with a fixed, elongated, cylindrical sleeve housing and an elongated rotatable cylindrical sleeve positioned within the sleeve housing, both enclosing a piston chamber. A first longitudinal opening or access port is formed in the fixed sleeve housing and a corresponding second longitudinal opening or access portion is formed in the rotatable sleeve. The rotatable sleeve is reversibly movable about the central axis of the piston chamber from a first, open position with the first and second access ports in register to a second, closed position with the access ports out of register. The edges of the sleeve access ports may be sharpened and angularly disposed to shear portions of product remaining within the hopper and to disperse those portions as the rotatable sleeves are moved. The device, in addition, may be provided with a agitator to disperse the product within the hopper and to urge product towards the piston pumps.

35 Claims, 10 Drawing Sheets

PISTON PUMP FOR EASILY DAMAGED PRODUCTS

FIELD OF THE INVENTION

This invention relates to devices for pumps and processing devices for relatively delicate or easily damaged products. The invention may pump such products, to molds, casings, pouches, receptacles or other processing devices and is particularly suitable for use with whole muscle meat products and relatively delicate food products such as poultry parts, prepared food mixtures and the like.

BACKGROUND OF THE INVENTION

The processing and packaging of many goods, including foods, frequently requires dispensing relatively delicate or easily damaged products into molds, casings, other packaging or containers without overprocessing or unduly disturbing the composition and integrity of the product. This is particularly important in the processing of food products such as poultry parts, whole muscle or luncheon meat products, prepared foods containing cubed and diced or sliced meat, poultry, or fish and other formulations.

Overprocessing of relatively delicate or easily damaged products by excess grinding, mixing or transferring, for example, will often significantly affect the composition and appearance of the products, and for food products, the flavor, texture and overall palatability of the products. At the same time, however, such products must often be quickly and efficiently transferred from a storage container or processing hopper to appropriate packaging in an economical and reliable manner. It is also frequently necessary to employ a single flexible system to continuously pump, process or package both small batch quantities for limited runs and large continuous volumes for commercial distribution.

Devices used for such purposes often operate both at room temperatures and air pressures, at elevated or lowered temperatures, and in applications requiring vacuum (negative air pressure) conditions to deaerate the products prior to packaging. Deaeration of the products, particularly food products, improves the texture and appearance of the final packaged goods, appreciably increases the taste and shelf-life of the packaged goods and eliminates unwanted voids in the packaged goods.

It is frequently desirable, in addition, to use piston pumps to dispense predetermined quantities of such relatively delicate or easily damaged products to the appropriate mold, casing, packaging or receptacle. These piston pumps must operate efficiently and at sufficient speeds to maintain economical processing operations. Moreover, the piston pumps must be durable, relatively simple to maintain, and easy to clean between processing operations to satisfy health and sanitary standards.

SUMMARY OF THE INVENTION

It is an object of the invention to provide an improved pumping device for relatively delicate or easily damaged products that is efficient, durable and easily maintained.

It is a further object of the invention to provide an improved pumping device that dispenses relatively delicate or easily damaged products, such as whole muscle meats and fragile foods, continuously, efficiently and without degrading or overworking the products.

It is another object of the invention to provide an improved food pumping device with an improved piston pump operable in conjunction with heating, cooling and vacuum deaeration systems.

Further and additional objects will be apparent from the following description, drawings and claims.

In one embodiment, for food products, the invention comprises a sealable hopper, preferably of stainless steel, for receiving a volume of the product. The hopper may be heated or cooled and is adaptable for both deaerating applications and for use in non-deaerating operations. The hopper may be provided with a hatch opening and a fill tube having a deaeration enhancing inlet valve to permit both batch and continuous processing of the product.

The hopper is preferably shaped to gravity feed the product into at least one, and preferably two, synchronized piston pumps positioned proximate to the bottom of the hopper. The piston pumps displace the product from the interior of the hopper into a consolidating feed manifold where the product is then dispensed through a discharge conduit into suitable packaging materials, processing systems or other vessels or conduits. When the invention is used in conjunction with a vacuum system to deaerate the product, the piston pumps and consolidating feed manifold also prevent the loss of negative air pressure during the pumping operation.

Each of the piston pumps preferably includes a pump cylinder enclosing a piston chamber or cavity. The pump cylinder preferably comprises a fixed, elongated, cylindrical sleeve housing and an elongated rotatable cylindrical sleeve positioned within the sleeve housing. Alternatively, the cylindrical sleeve housing may be rotatable around a fixed cylindrical sleeve positioned within the cylindrical sleeve housing as both of the cylindrical sleeves may be rotated. A first longitudinal opening or access port is formed in the fixed sleeve housing extending from the front to the rear of the housing. A corresponding second longitudinal opening or access port is formed in the rotatable sleeve. A hollow drive shaft keyed to a rotary actuator is connected to, and opens into, the rear wall of the rotatable sleeve. With this arrangement, the rotatable sleeve is reversably movable about the central axis of the piston chamber from a first, opened position to a second, closed position.

In the opened position, the longitudinal opening in the rotatable sleeve is registered with the longitudinal opening in the fixed housing to permit product to pass from the hopper into the piston chamber. In the closed position, the opening in the rotatable sleeve is moved out of register with the opening in the housing to form a closed cylinder preventing the passage of product from the hopper into the piston chamber.

One or more of the edges of at least the opening in the rotatable sleeve are preferably sharpened to cut and shear away any product that is only partially within the pump chamber when the rotatable sleeve is moved from an opened to a closed position. At least one of these longitudinal edges is disposed at an angle relative to the central axis of the piston chamber to exert a progressive, scissor-like cutting action on the product as the rotatable sleeve is closed.

In the preferred embodiment, each pump is further provided with an ejection piston including a piston plate disposed within the piston chamber made of a tough, durable polymeric material. The piston plate is mounted on a piston rod extending through the hollow drive shaft of the rotatable sleeve to a hydraulic cylinder. When the piston is actuated by the hydraulic cylinder, the piston plate advances from the rear to the front of the piston chamber or cavity to positively expel product from the piston chamber through a consolidating feed manifold and into suitable receptacles, conduits or packaging.

The piston plate is shaped to seal against the interior surfaces of the rotatable sleeve and the fixed sleeve housing. In the preferred embodiment, the piston plate is provided with a radially extending peripheral collar section that extends through the longitudinal opening in the rotatable sleeve. This collar section improves the sealing engagement between the piston plate and the interior surfaces of the sleeve housing.

In the preferred embodiment, the piston pumps are disposed side by side near the bottom of the hopper to allow gravity feed of products into the pump chambers or cavities. The movement of the ejection pistons and rotatable sleeves of each pump are synchronized to provide a consistent and continuous flow of product to the consolidating manifold. The sleeves of each pump, in addition, preferably rotate in opposite directions towards the center of the hopper. This centrally disperses any small pieces of sheared product within the hopper to help ensure a consistent product composition and to prevent undesirable accumulation or clumping of small pieces within the device.

In the preferred embodiment, the consolidating feed manifold comprises at least one, and preferably two, adjoining transmission passages in communication with the piston chambers or cavities. In the preferred embodiment, a transmission passage is in communication with each piston chamber. These transmission passages merge into a central convergence chamber sized to receive alternating surges of product from the piston pumps. The product exits the convergence chamber through a discharge conduit, preferably located opposite the transmission passages, to appropriate casings, molds, containers or the like.

The central convergence chamber may be supplied with a movable diverting mechanism, preferably powered by rotary actuators, pneumatic cylinders, hydraulic cylinders or the like, that alternately seals the transmission passages during the pump cycles. As product is supplied to the convergence chamber through one of the transmission passages, the diverting mechanism is moved to engage the opening of the off-cycle transmission passage to prevent backflow of product. The diverting mechanism may also be adapted to prevent loss of negative air pressure from within the hopper when deaeration of the product is desired.

The hopper, in addition, may be provided with a mechanical agitator to open and expose the product to a deaeration vacuum, to eliminate product voids and to enhance the deaerating operations of the device. This agitator preferably includes a first helical flighted section to agitate and move food product from the rear to the front of the hopper. The agitator also preferably includes a second section of hoop and paddle flighting to agitate the product and to urge the product into the piston pumps. The agitator is also preferably disposed proximate to the bottom of the hopper to aid the movement of product into the pumps and to evenly distribute product and pieces of product within the hopper.

The invention, in addition, is not limited to the above recited embodiments or to use with the above mentioned food products. Rather, it includes further embodiments discussed and shown below in the drawings, description and claims, and their equivalents.

DETAILED DESCRIPTION OF THE INVENTION

Figure 1:
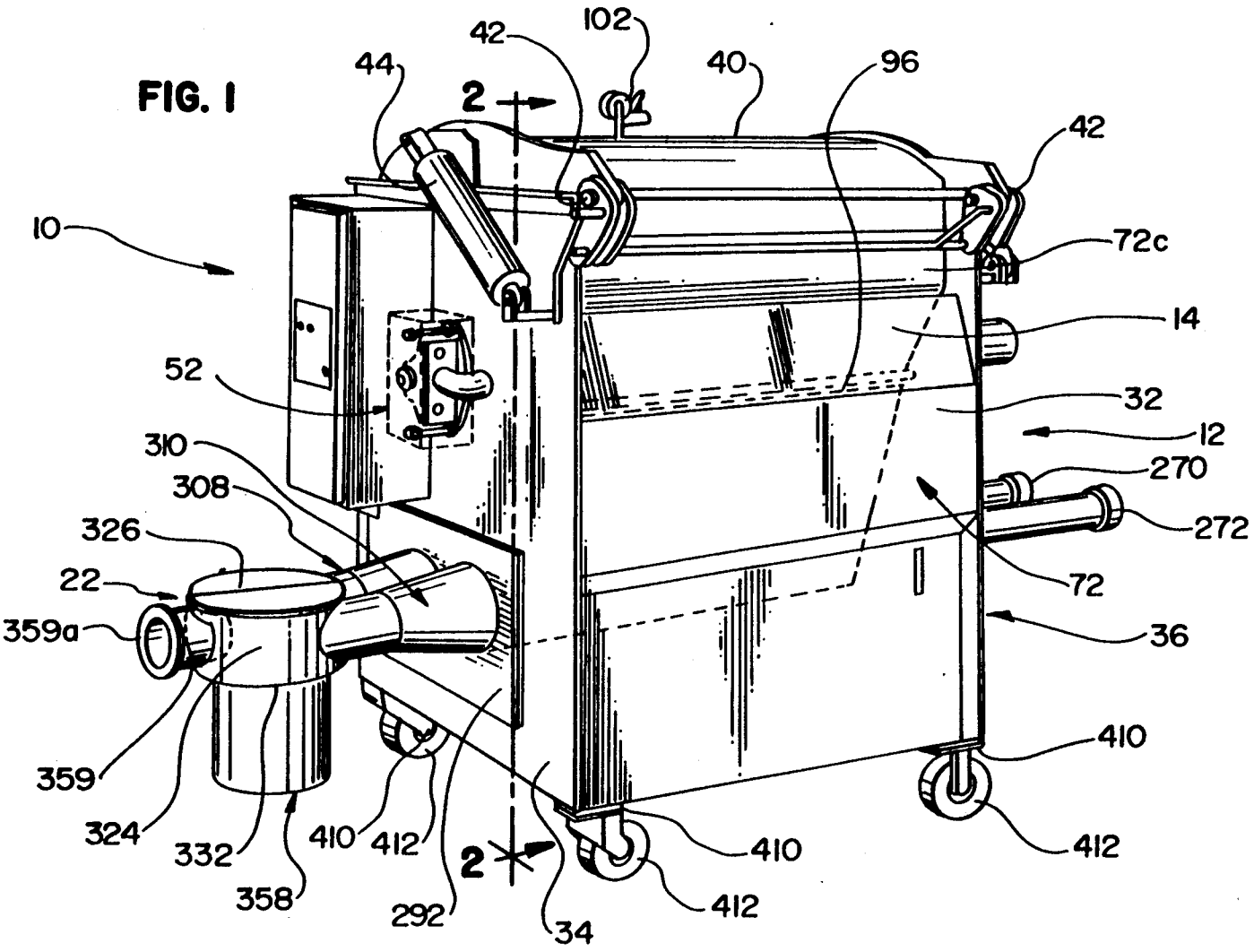
FIG. 1 is a perspective view with phantom lines of one embodiment of a device with the improved pumps of the invention and an embodiment of a consolidating feed manifold having a crescent diverting gate mechanism.
Figure 2:
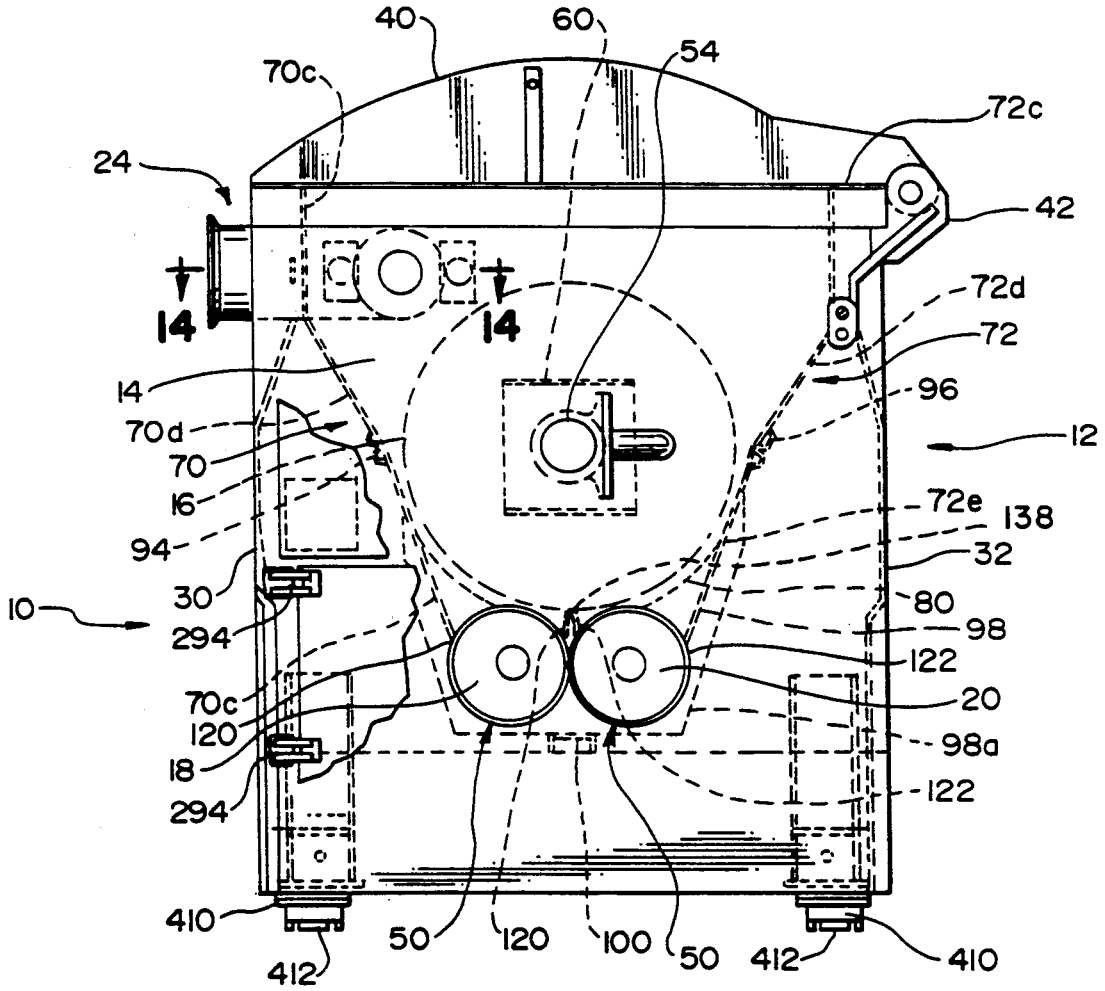
FIG. 2 is a fragmentary front elevational view with phantom lines of the embodiment of the invention shown in FIG. 1 taken along line 2—2.
Figure 3:
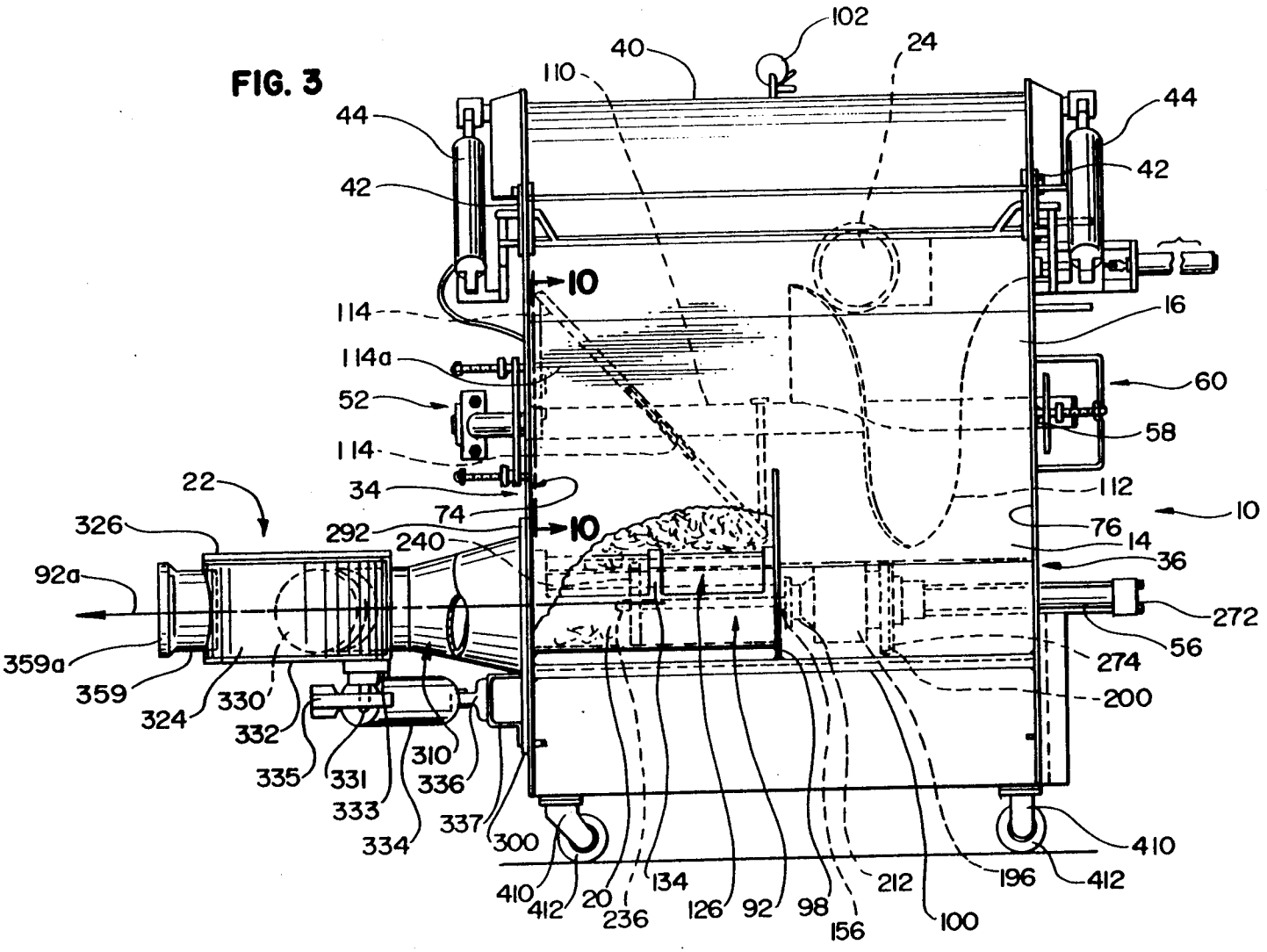
FIG. 3 is a side elevation view with phantom lines of the embodiment of the invention shown in FIG. 1, with an alternative embodiment of the consolidating feed manifold having a planar diverting gate mechanism.

As shown in the Figures, and particularly FIGS. 1-3, one embodiment of the pumping device of the invention 10, adapted for use for food products, includes a housing 12 enclosing a hopper 14, or other holding vessel, channel system, tube system or the like, for holding and processing relatively delicate products, an optional agitator 16, operatively disposed within the hopper 14, and dual pump cylinders 18 and 20 disposed to receive product from the hopper 14. A consolidating feed manifold 22 is operatively connected to the housing 12 in communication with the piston pump cylinders 18 and 20. The housing 12 may also be provided with a deaeration enhancing inlet valve ("DEIV") 24 used in conjunction with a product fill tube (not shown) for the continuous supply of product to the hopper 14, for use when the device 10 is operating in a deaerating configuration.

As shown in FIGS. 1-3, the housing 12 comprises side panels 30 and 32, a front panel 34 and rear panel 36. The hopper 14 may be open or may be provided with a sealable top hatch 40 to complete the housing 12. In the preferred embodiment, the device 10, including the housing, is primarily made of No. 300 series stainless steel or other U.S.D.A. approved tough, durable and easily cleaned materials. When used, the top hatch 40 is joined to the housing 12 by an articulated locking hinge 42 and may be provided with viewing ports (not shown). In the embodiment shown in FIGS. 1-3, pneumatic or hydraulic cylinders 44 extend between the hatch 40 and the front and rear panels 34 and 36 to permit the selective movement of the hatch 40 between an opened and closed position.

The housing front panel 34 includes front pump access ports 50 and front agitator mounting assembly 52 proximate to the agitator mounting opening 54. Similarly, the housing rear panel 36 includes rear pump access ports 56, rear agitator access opening 58 and rear agitator mounting assembly and gear box 60.

As shown in FIGS. 1-3, the hopper 14 comprises a pair of opposed side walls 70 and 72, and front wall 74 and rear wall 76 formed by the interior surfaces of the housing front panel 34 and rear panel 36. End angles provided with a flexible rubber gasket or similar such material may be attached to the upper edges of the hopper walls 70 and 72, and front wall 74 and rear wall 76 to engage the top hatch 40 and to seal the hopper 14 from the outer atmosphere. This permits the operation of the device in configurations employing vacuum (negative air pressure) systems to deaerate product held in the hopper 14.

Figure 4:
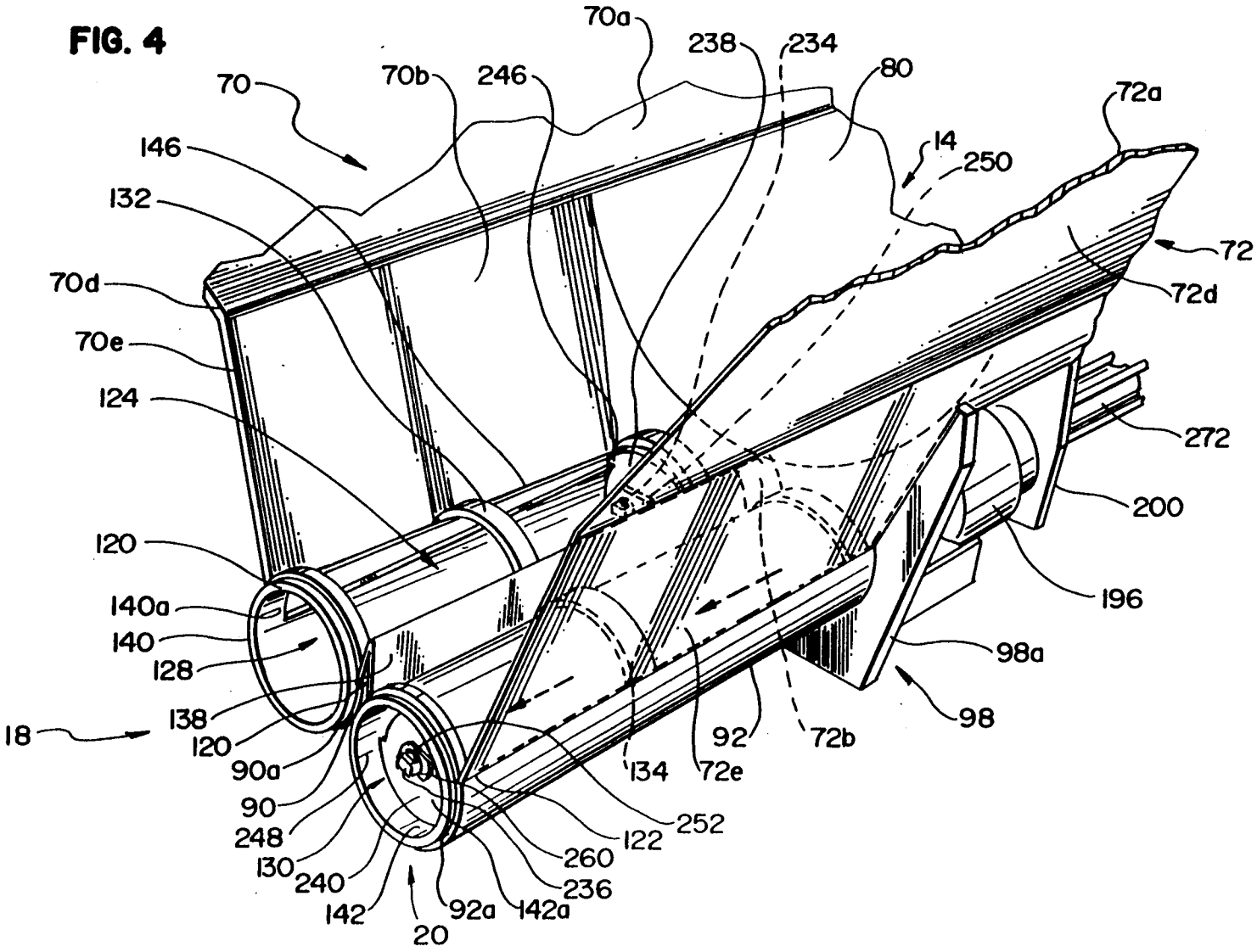
FIG. 4 is an isolated fragmentary perspective view of the interior of the embodiment of the invention shown in FIG. 1.

As shown in FIGS. 2 and 4, the hopper side walls 70 and 72 are preferably made of stainless steel or other such U.S.D.A. acceptable, tough, durable and easily cleaned materials. The hopper side walls 70 and 72 are inclined toward the bottom of the device 10 to promote the downward, gravity feed movement of product within the hopper 14. As shown in FIG. 4, the rearward portions **70*a* and 72*a* of the side walls 70 and 72 extend downwardly to a curved bottom 80 of the hopper 14. The curved bottom 80 is also positioned to encourage the movement of product toward the piston pumps 18 and 20. The forward portions 70*b* and 72*b* of the hopper side walls 70 and 72 extend downwardly to cylindrical sleeve housings 90 and 92 of the piston pumps 18 and 20**.

In the preferred embodiment, the hopper side walls 70 and 72 include first vertical upper wall sections **70*c* and 72*c*. Second hopper wall sections 70*d* and 72*d* extend inwardly from the lower boundary of the upper sections, 70*c* and 72*c*, to third lower hopper wall sections 70*e* and 72*e*. The third sections 70*e* and 72*e* extend inwardly at an angle to the curved bottom 80 of the hopper 14 and the sleeve housings 90 and 92**.

As shown in FIGS. 1 and 2, the hopper 14 is preferably reinforced with stainless steel or similar durable, U.S.D.A. acceptable, side wall brace channels 94 and 96 spanning the junction of the second and third wall sections **70*d*, 70*e* and 72*d*, 72*e*. These brace channels 94 and 96 extend the full length of the hopper side walls 70 and 72**.

As shown in FIGS. 2-4, the hopper bottom 80 spans the distance from the housing rear panel 36 to a transition plate 98 disposed intermediate the housing front panel 34 and rear panel 36. In the preferred embodiment, the transition plate is also of stainless steel and the periphery **98*a* of the plate may extend beyond outer edges of the curved hopper bottom 80**.

As shown in FIGS. 2 and 4, the transition plate 98 forms a vertical "step-down" to a U-shaped support channel 100. The support channel 100 extends from the housing front panel 34 to the housing rear panel 36.

In the preferred embodiment, as shown in FIGS. 1-3, the interior of the hopper 14, is collectively defined by the side walls 70 and 72, front wall 74, rear wall 76, curved bottom wall 80, sleeve housings 90 and 92, and transition plate 98. When used in conjunction with the top hatch 40, the hopper 14 may be adapted to comprise a vacuum chamber for receiving products for pumping and/or processing. The products may be pumped in batches supplied to the hopper 14 through an opened top hatch 40, an opened hopper 14, or continuously by vacuum feed or other means from a remote hopper or vat (not shown) using a fill tube in conjunction with the DEIV 24.

The top hatch 40 may be provided with a vacuum-fitting to permit coupling to a source of negative pressure so that the hopper 14 may be evacuated of air during deaeration operations. Alternatively, a self-contained negative pressure source (not shown) may be operatively disposed within the housing 12 and connected to a vacuum fitting or another such fitting in communication with the hopper 14. The hatch may also be provided with a vacuum gauge 102 to monitor conditions within the hopper.

The hopper 14, in addition, may be of other dimensions and may be equipped with heating elements (not shown) to process the food products at elevated temperatures, including resistance elements, steam fittings, jackets or other heating means known to the art. Similarly, the hopper may be equipped with cooling means (not shown) to process food products at lowered temperatures, including refrigerant coils, nitrogen ports, nozzles or other such cooling apparatus known to the art.

Figure 10:
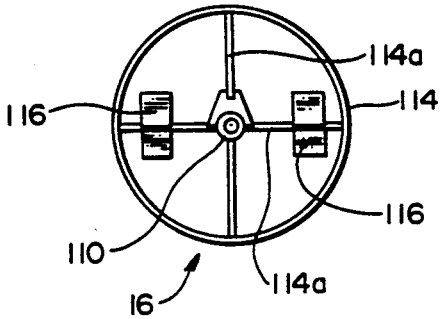
FIG. 10 is a fragmentary front elevation of the agitator shown in FIGS. 1 through 3 taken along line 10—10 in FIG. 3.

As shown in FIGS. 3 and 10, the agitator 16 comprises an elongated shaft 110 mounted and supported by the front agitator mounting assembly 52 and rear agitator mounting assembly and gear box 60, both with suitable mounting brackets and rotatable bearing elements. In the preferred embodiment, the agitator 110 shaft supports a section of ribbon flighting 112 arranged in a generally helical pattern to promote the agitation of the product within the hopper 14 and the movement of the product from the rear of the hopper 14 towards the pump cylinders 18 and 20. As shown in FIGS. 3 and 10, the agitator shaft 110 also preferably supports hoop members 114 and paddle members 116. These members 114 and 116, with the helical flighting 112, agitate and open voids in the product and urge the product into the pumps 18 and 20, as well as encourage the even distribution of the product and portions of the product within the hopper 14. One or more of the hoop support members 114*a* may also be positioned to scrape and wipe product from the face of the hopper front wall 74.

The agitator 16 is preferably equipped to operate at various speeds depending on the application and type of product being processed. In many instances, the agitator 16 will rotate relatively slowly to ensure proper mixing and deaeration without undue injury or overworking of relatively delicate products. A drive means (not shown) is operatively coupled to the rear agitator mounting assembly and gear box 60 to rotate the agitator 16.

In the preferred embodiment, the drive means is mounted on the device 10 or proximate to the device and may consist of a variable-speed, hydraulic or pneumatic drive, a gear system, a chain and sprocket transmission or similar such systems. Alternatively, the drive motor may be a remote power source and may use other transmission systems known to those in the art. Similarly, the drive motor and transmission system is preferably equipped to operate at a variety of speeds depending on the expected use of the device 10.

As shown in FIGS. 2 and 3, the agitator 16 may be spaced generally below the DEIV 24, in close proximity to the curved hopper bottom wall 80 and the piston pumps 18 and 20. In configurations using an agitator 16, the level of the product within the hopper 14 starts just below the top of the helical flighting 112 and hoop member 114. A level of product between the top and bottom of the flighting 112 is maintained in continuous operations until completion of the processing procedure. The device 10 in automated operations may also be provided with automatic high-low product level controls such as those known in the art to monitor and to control the automatic feed of product into the hopper 14.

As shown in FIGS. 3–8 the cylindrical sleeve housings 90 and 92 comprise one component of the dual pump cylinders 18 and 20. The sleeve housings 90 and 92 are preferably of stainless steel or another tough, durable, non-galling, U.S.D.A. acceptable, and easily cleanable material. They are preferably welded to the transition plate 98 and to the hopper front wall 74 proximate to the front pump access ports 50.

Figure 5:
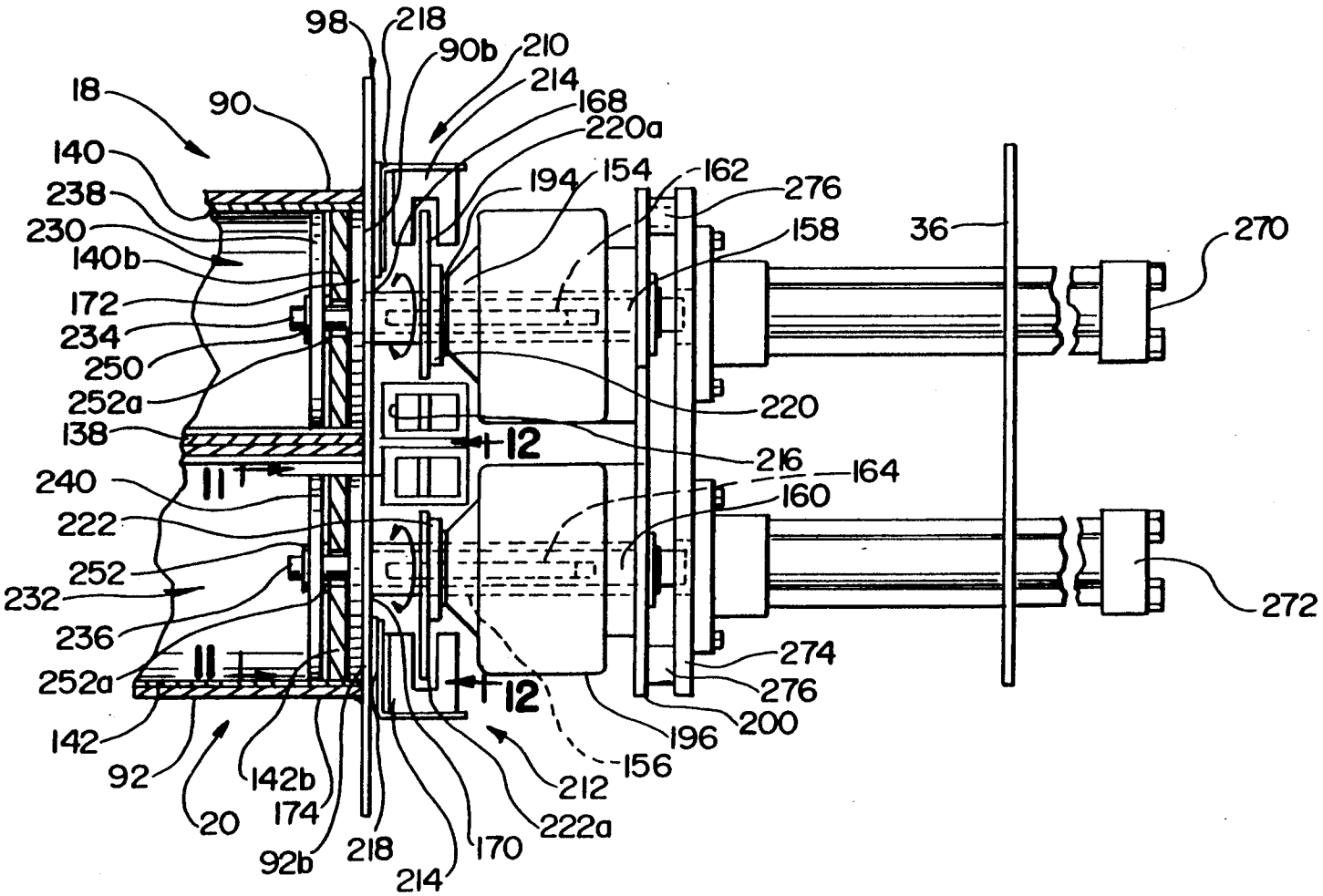
FIG. 5 is a fragmentary top sectional view of the rear portions of the pump cylinders shown in FIGS. 2 through 4, with parts removed.
Figure 6:
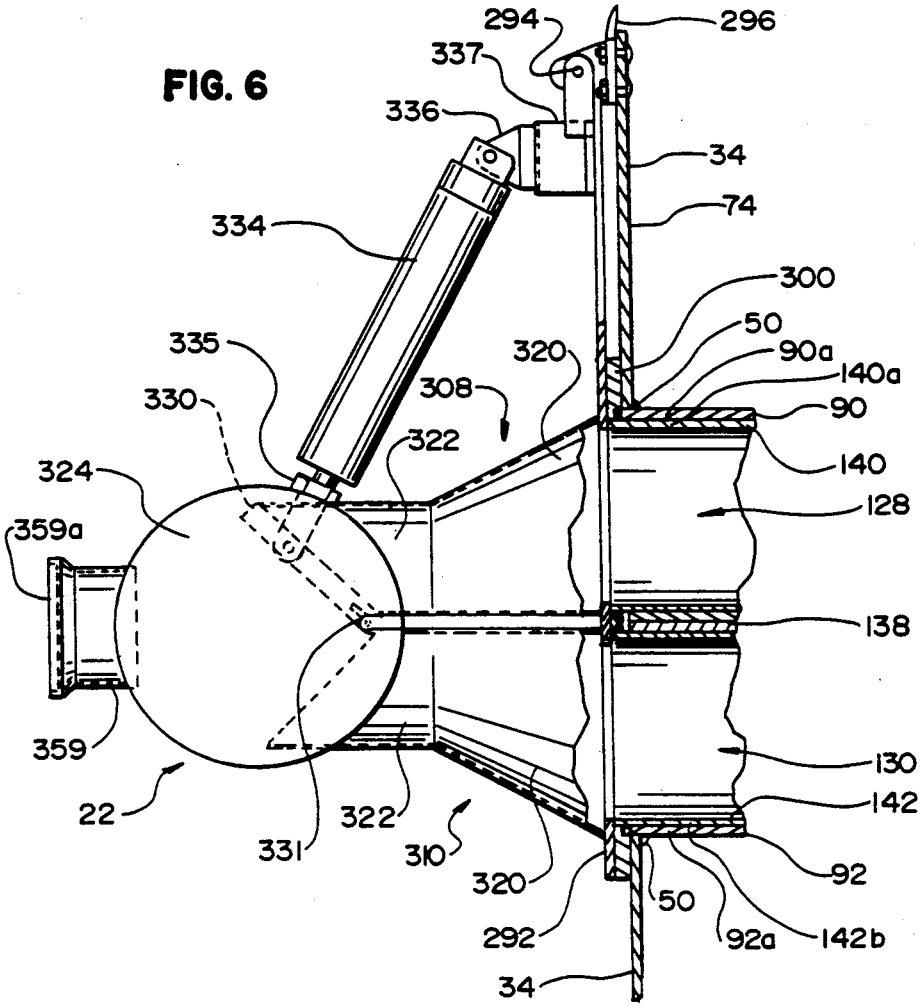
FIG. 6 is a fragmentary top sectional view of the front portions of the pump cylinders and the consolidating feed manifold of the invention shown in FIGS. 1 and 3, where the consolidating feed manifold has the planar diverting gate mechanism shown in FIG. 3.

As shown in FIGS. 4 and 6, the sleeve housings 90 and 92 include open forward portions 90*a* and 92*a* adjacent to the front pump access ports 50 and, as shown in FIG. 5, rear walls 90*b* and 92*b* formed by the interior surface of the transition plate 98. The peripheral wall edges 120 and 122 are formed along sleeve housing openings 124 and 126. These openings 120 and 122 permit movement of product from the hopper 14 into the piston chambers or cavities 128 and 130. In the preferred embodiment, the openings 124 and 126 extend for approximately 140 degrees of the circumference of each sleeve housing 90 and 92 and may be sharpened to a cutting edge.

The sleeve housings 90 and 92, in addition, may be provided with circumferential reinforcing bands 132 and 134 disposed intermediate of the forward portions 90*a* and 92*a* and rear walls 90*b* and 92*b* of the sleeve housings. These reinforcing bands 132 and 134 strengthen the sleeve housings 90 and 92 and prevent spreading or other deformation of the housings 90 and 92 during operation of the invention. In the preferred embodiment, each reinforcing band 132 and 134 is located at approximately the midpoint of its respective sleeve housing.

As shown in FIGS. 2, 5 and 7–8, the sleeve housings 90 and 92 are attached to the transition plate 98, in a side-by-side parallel relation. The sleeve housings 90 and 92 are also disposed a vertical distance from the curved hopper bottom 80 to ensure the optimum movement of product from the hopper 14 into the piston pumps 18 and 20. In the preferred embodiment, the sleeve housings 90 and 92 are positioned on the transition plate 98 so that the uppermost circumferential arc of the sleeve housing openings 124 and 126 are somewhat below the forward edge of the curved hopper bottom 80.

An inverted V-shaped product guide 138 is placed above the two sleeve housings 90 and 92, straddling the space between the pair of adjacent sleeve housing edges 120 and 122 to guide food product into the pumps 18 and 20. The product guide 138 preferably extends the length of the housings 90 and 92 and is composed of U.S.D.A. approved stainless steel or another such material. One of the V-legs of the product guide 138 is attached to, or is proximate to, the adjacent sleeve housing peripheral edges 120 and 122.

As shown in FIGS. 3–8, the pump cylinders 18 and 20 are further provided with cylindrical rotatable sleeves 140 and 142 nested within the sleeve housings 90 and 92 to enclose the piston chambers 128 and 130. The rotatable sleeves 140 and 142 each comprise an outer wall section with longitudinal peripheral edges 146 and 148 formed along openings 150 and 152 in the sleeve wall. In the preferred embodiment, the opening in each sleeve wall 150 and 152 extends for approximately 140 degrees of the circumference of the sleeves 140 and 142.

The rotatable sleeves 140 and 142 are further provided with open forward ends 140*a* and 142*a* and rear end walls 140*b* and 142*b*. As shown in FIGS. 4 and 6, the sleeve forward ends 140*a* and 142*a* extend a distance past the sleeve housing open forward portions 90*a* and 92*a* and through the front pump access ports 50. As shown in FIGS. 3 and 5, hollow piston shafts 154 and 156 extend centrally and laterally from the exterior of the sleeve rear end walls 140*b* and 142*b* Each piston shaft 154 and 156 is provided with an axial bore 158 and 160, opening into the piston chambers 128 and 130 respectively. Protruding key flanges 162 and 164 are formed on the exterior of the hollow piston shafts 154 and 156, and extend along at least a portion of the length of the shafts 154 and 156.

As shown in FIGS. 4 and 7–9, one or both of the longitudinal peripheral edges 146 and 148 of the preferred rotatable sleeves 140 and 142 may be machined to form knives or knife-like leading edges for slicing away any product that extends partially into the piston chambers 128 and 130. As shown in FIGS. 5 and 7–9, the peripheral edges 146 and 148 may also be angularly disposed relative to the longitudinal axis of the piston chambers 128 and 130. They are preferably at an angle of approximately 10 degrees and extend substantially from the sleeve forward ends 140*a* and 142*a* to a point near the sleeve rear walls 140*b* and 142*b*.

The peripheral edges 146 and 148 cooperate with the sleeve housing edges 120 and 122 to provide a progressive scissor-like slicing action when the sleeves 140 and 142 are rotated. This scissor-like action efficiently separates portions of excess product from product within the pump cylinders 18 and 20, and urges the portions or partial product portions to a central area in the hopper for redistribution within the hopper. This also helps to produce relatively uniform and consistent product output.

As shown in FIGS. 4 and 5, when the rotatable sleeves 140 and 142 are in place within the sleeve housings 90 and 92, the piston shafts 154 and 156 of rotatable sleeves 140 and 142 extend through shaft openings 168 and 170 in the transition plate 98. Bearing support plates 172 and 174 are interposed between the sleeve rear walls **140*b* and 142*b* and the sleeve housing rear walls 90*b* and 92*b* to facilitate the rotational movement of the sleeves 140 and 142 and to protect the sleeves 140 and 142 and sleeve housings 90 and 92** from excessive wear.

The bearing support plates 172 and 174 are made of ultra-high molecular weight polyethylene and may be provided with resilient seal members, such as rubber quad rings or other similar materials, to engage exteriors of the rotatable sleeve rear walls **90*b* and 92*b* and prevent leakage of product out of the pump cylinders 18 or 20 or air into the hopper during deaeration procedures. Similarly, the peripheral edges of the rotatable sleeve open forward ends 140*a* and 142*a*, shown in FIGS. 4 and 6, may be provided with resilient sealing members to seal against the inner surfaces of the sleeve housings 90 and 92**.

As shown in FIGS. 3 and 5, the hollow piston shafts 154 and 156 preferably extend through the central cores of rotary actuators 194 and 196. Such rotary actuators are commonly known in the art and the preferred actuator includes those known by the trade name Hyd-ro-ac sold by Textron, Berne, Ind. The rotary actuators 194 and 196 are powered by hydraulic systems (not shown) and are attached to mounting plate 200 positioned a predetermined distance from the transition plate 98. Other actuators, including those using various geared, belted, pneumatic, rack and pinion or other such designs, may also be used.

As shown in FIG. 5, the key flanges 162 and 164 protruding from piston shafts 154 and 156 are adapted to positively engage corresponding keyways formed in the central bores of the rotary actuators 194 and 196. Thus, when the rotary actuators 194 and 196 are energized, they axially rotate the sleeve 140 and 142 in either a clockwise or counterclockwise direction.

Figure 8:
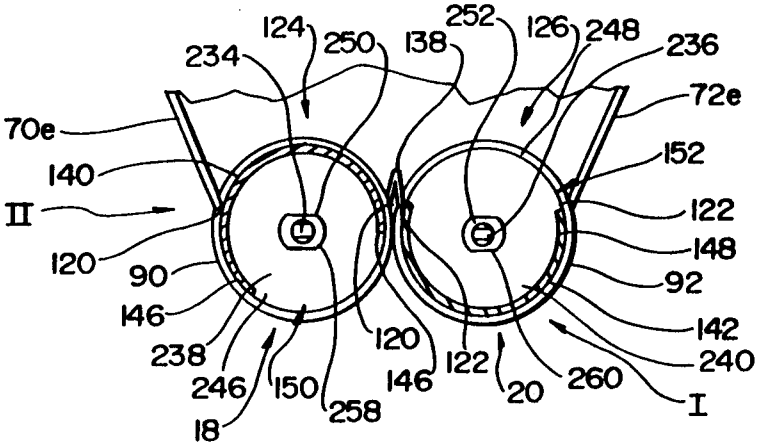
FIG. 8 is a fragmentary sectional view of the piston cylinders shown in FIGS. 3 through 6 with the left cylinder in a closed position II and the right cylinder in an opened position I.
Figure 9:
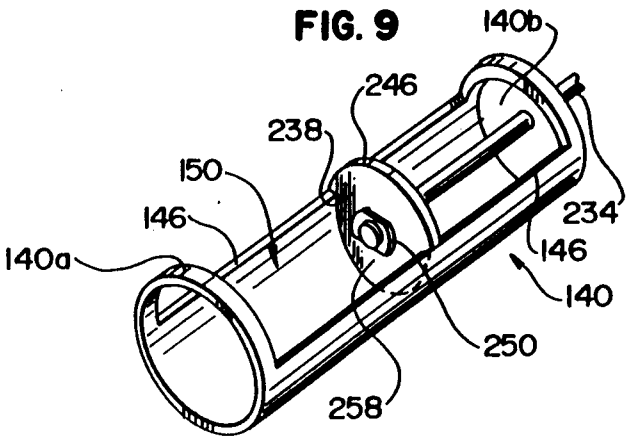
FIG. 9 is an isolated fragmentary perspective view of a cylinder sleeve as shown in FIGS. 3 and 4.
Figure 7:
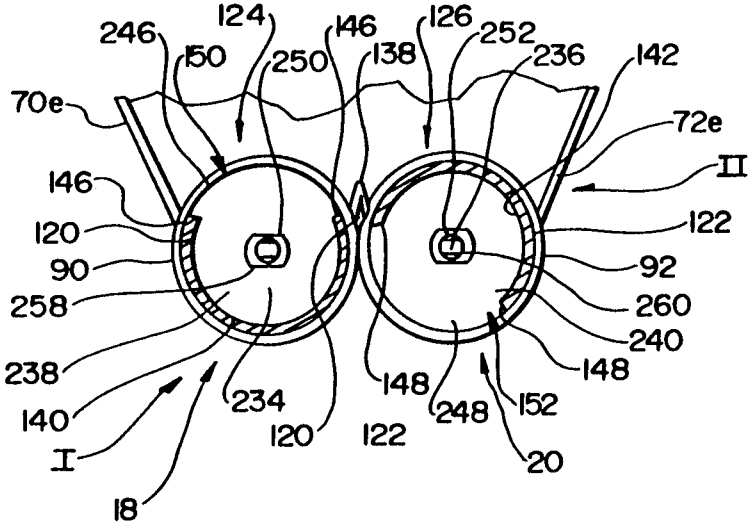
FIG. 7 is a fragmentary sectional view of the piston cylinders shown in FIGS. 3 through 6 with the left cylinder in an opened position I and the right cylinder in a closed position II.

As shown in FIGS. 4, 5, 7 and 8, the piston shafts 154 and 156 and the rotary actuators 194 and 196 are oriented so that the sleeves 140 and 142 alternately rotate from a first open position I to a second closed position II. In the preferred embodiment, as shown in FIGS. 7 and 8, the sleeve 140 and 142 are turned in opposing directions so that both sleeves 140 and 142 are rotated towards the center of the hopper 14.

When the rotatable sleeves 140 and 142 are in the first open position I (FIG. 7) their peripheral edges 146 and 148 are positioned in register with the peripheral edges 120 and 122 of the sleeve housings 90 and 92. In this position, the piston chambers 128 and 130 are open to the hopper 14 to permit movement of product into the chambers.

As the sleeves 140 and 142 are alternately rotated to their second closed position II (FIG. 8) their longitudinal peripheral edges 146 and 148 are moved out of register with the peripheral edges 120 and 122 of the sleeve housings 90 and 92. This rotation continues until the outer walls of the rotatable sleeves 140 and 142 completely close-off the sleeve housing openings 150 and 152 and form a closed cylinder so that product can be discharged through the sleeve openings **140*a* and 142*a***.

Figure 12:
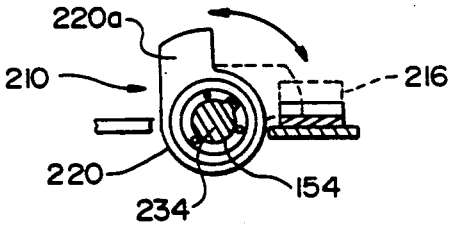
FIG. 12 is a fragmentary front elevation view of a pump cylinder position detector taken along line 12—12 of FIG. 5.
Figure 11:
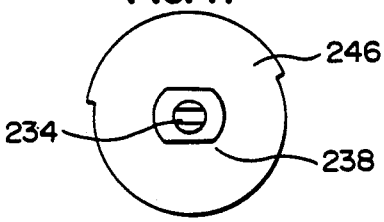
FIG. 11 is a fragmentary front elevation of a plunger plate taken along line 11—11 of FIG. 5.

As shown in FIGS. 3, 5 and 12, the pump cylinders 18 and 20 are further preferably provided with pump cylinder position detectors 210 and 212 disposed between the transition hopper plate 98 and the rotary actuators 194 and 196 to control the angular position of the rotatable sleeves 140 and 142. Each of the two pump cylinder position detectors 210 and 212 preferably includes first U-shaped induction sensors 214 and second U-shaped induction sensors 216 attached by brackets 218 to the transition plate 98. Induction sensors are well known to the art and the preferred sensors include those sold under the trade name Turck Inductive Sensor, by Turck Multiprox, Inc., Minneapolis, Minn. Other mechanical and electro-mechanical, and electrical devices such as various switches, stop members and the like may also be used as alternatives to the induction sensors.

As shown in FIGS. 5 and 12, each set of the pump cylinder induction sensors 214 and 216 are disposed to receive the lobe portions **220*a* and 222*a* of actuating cams 220 and 222 within the U-legs of the sensors. The cams 220 and 222 are secured to the rotary actuators 194 and 196 and are positioned between the rotary actuators 194 and 196 and the transition plate 98. The first pump cylinder induction sensors 214 are arranged to detect the lobe position of the cams 220 or 222 when the rotating sleeves 140 and 142 are in their open position I discussed above. The second pump cylinder induction sensors 216 are positioned to detect the location of the cams 220 or 222 when the sleeves 140 and 142 are in the closed position II. Both sets of pump cylinder sensors 214 and 216 signal the rotary actuators 194 and 196 to cease further rotation when the sleeves are either fully open or fully closed. The pump cylinder position detectors 210 and 212 are further sequenced to permit alternating, synchronized rotation of the sleeves 140 and 142**, so that as one sleeve moves to a closed position, the other sleeve is rotated to an open position.

As shown in FIGS. 3–9, the pumps 18 and 20 are further provided with cylinder pistons 230 and 232 comprising piston rods 234 and 236, and piston plunger plates 238 and 240 mounted to the piston rods 234 and 236. The piston plunger plates 238 and 240 are preferably generally disk-shaped plates of ultra-high molecular weight polyethylene or similar non-ferrous, non-binding, self-lubricating materials or combination of such materials. Central openings are formed in the plunger plates 238 and 240 for receiving the forward end of the piston rods 234 and 236. These openings are sized to allow the plunger plates 238 and 240 to freely rotate on the piston rods 234 and 236.

As shown in FIGS. 4, 7–9 and 11, the diameters of the piston plunger plates 238 and 240 are preferably sized to provide sealing engagement between the periphery of the plunger plates 238 and 240, the sleeve housings 90 and 92 and the rotatable sleeves 140 and 142. In the preferred embodiment, the plunger plates 238 and 240 are additionally provided with radially outwardly extending peripheral collar sections 246 and 248 to enhance the seal against the interior surfaces of the sleeve housings 90 and 92.

These collar sections 246 and 248 extend between the rotatable sleeve longitudinal peripheral edges 146 and 148 to engage the inner surface of the sleeve housings 90 and 92. The edges of the collar sections 246 and 248 are recessed slightly from the rotatable sleeve longitudinal edges 146 and 148 to prevent binding or rubbing between the plunger plates 238 and 240 and the longitudinal peripheral edges 146 and 148 during operation of the pumps. In the preferred embodiment, the collar sections 246 and 248 measure approximately 138 degrees of the circumference of the plunger plates 238 and 240.

As shown in FIGS. 4, 5 and 7–9, when installed on the piston rods 234 and 236, the plunger plates 238 and 240 are retained in position with retaining plate sleeves 250 and 252 and fixed back stop washer members **250*a* and 252*a* disposed behind the plunger plates 238 and 240. The forward ends of the piston rods 234 and 236 are reduced in diameter and threaded to receive the correspondingly threaded retaining plate sleeves 250 and 252. These forward ends of the piston rods 234 and 236 extend through the plunger plates 238 and 240. The retaining plate sleeves 250 and 252 are threaded onto the piston rods 234 and 236 and are tightened to press the back stop washers 250*a* and 252*a*. The retaining plate sleeves 250 and 252 are preferably configured so that spare from the back stop washers 250*a* and 252*a* is allowed to permit the free rotation of the plunger plates 238 and 240**.

As shown in FIG. 5, the piston rods 234 and 236 extend through ports and in the rotatable sleeve rear end walls **140*b* and 142*b*, into the piston shaft bores 158 and 160, through the entire length of the piston shafts 154 and 156 to hydraulic cylinders 270 and 272. The piston rods 234 and 236 are operatively coupled to the hydraulic cylinders 230 and 232 to provide reversible lateral piston stroke movement during operation of the pumps. The hydraulic cylinders 270 and 272** used in the invention are well known to the art, and, in the preferred embodiment, include high pressure hydraulic cylinders such as those sold under the trade name "T-J TM Cylinders" by the Aeroquip Company. Other types of piston drives, such as pneumatic, electrical and similar drives may also be used.

The hydraulic cylinders 270 and 272 are bolted to the cylinder mounting plate 274. Hex head machine screws secure the cylinder mounting plate 274 to the mounting plate 200. The cylinder mounting plate 274 is further spaced from the mounting plate 274 by cylinder standoffs 276. The hydraulic cylinders 270 and 272 are powered by a separate hydraulic power source (not shown) that may be included within the housing 12 or at a remote location. The cylinders 270 and 272 also extend through rear panel access ports 56.

As shown in FIGS. 1, 3 and 6, the consolidating manifold 22 is secured to the manifold mounting plate 292, which is attached with hinge 294 to the exterior of the housing front panel 34. The hinge 294 is fixed to both the mounting plate 292 and the housing front panel 34 by hinge bolts and standoffs 296. The mounting plate 292 is secured in operative alignment with the pump cylinders 18 and 20 by knurled knobs (not shown) spaced along the borders of the mounting plate 292.

A transition plate 300 of ultra-high molecular weight polyethylene or similar materials, as mentioned above, with a sealing member (rubber quad ring or the like) is interposed between the mounting plate 292 and the housing front panel 34 opposite the pump access ports 52. The transition plate 300 is provided with openings corresponding to the pump access ports 52 allowing communication between the pump cylinders 18 and 20 and the transmission passages 308 and 310 of the consolidating discharge manifold 22. The transition plate 300 prevents leakage of product during operation of the pump cylinders 18 and 20 and accidental loss of negative air pressure when the device is operating in a deaerating configuration, as well as bearing support to the forward ends **140*a* and 142*a*** of the rotatable sleeves.

As shown in FIGS. 1, 3, 6 and 13, the transmission passages 308 and 310 are preferably disposed in a parallel adjoining relation. Each transmission passage 308 and 310 comprises a first tapering conduit segment 320 and a second cylindrical duct segment 322. The open end of each duct segment 322 extends a short distance through the side wall of a central, cylindrical convergence chamber 324 sized to receive alternating surges of product from the pump cylinders 18 and 20 through the transmission passages 308 and 310.

The cover 326 of the convergence chamber 324 is preferably removable for cleaning and inspection of the chamber 324. The cover 326 may be secured to the convergence chamber 324 with knurled knobs (not shown) and may be provided with a seal ring to prevent leakage from the convergence chamber 324.

Figure 13:
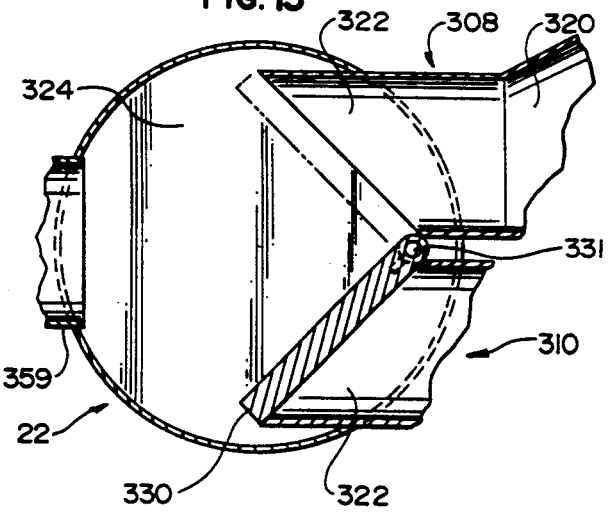
FIG. 13 is a fragmentary plan view of the consolidating feed manifold with the planar diverting gate mechanism shown in FIGS. 3 and 6 with parts removed.

As shown in FIGS. 1, 3, 6 and 13, 17 and 18, the central convergence chamber 324 also may be supplied with pivoting or rotating diverting gates disposed to alternatingly close the open ends of each transmission passage 308 and 310 within the chamber 324. The preferred embodiment of the diverting gate is the crescent configuration shown in FIGS. 1, 17 and 18. This embodiment is suitable for products such as whole muscle meats, as well as for particulate or emulsified products. The diverting gate may also be of a planer configuration, as shown in FIGS. 3, 6 and 13, which is suitable for certain types of products, such as particulate or emulsified foods and similar materials. Other configurations suitable for closing the transmission passages 308 and 310 may also be used.

The diverting gates prevent the backflow of food product from one transmission passage to the other during the pump cycles and help to maintain negative air pressure within the hopper 14 when the device is operating in a deaerating configuration. When correctly synchronized with pumps 18 and 20, the gates may also help to prevent or eliminate voids within the continuous product discharge during the pump cycles. The movement of the gates may also be timed so that the product in the pumps 18 and 20 and in the passages 308 and 310, may be initially precompressed by the pumps 18 and 20 to eliminate voids or pockets in the product before the pumps 18 and 20 advance the product through the consolidating feed manifold 22.

The embodiment of the consolidating feed manifold 22 shown in FIGS. 3, 6 and 13 is provided with a planar diverting gate 330. The planar gate 330 rotates on a gate pivot pin 331 attached to, or embedded in the gate 330. The pivot pin 331 extends through the bottom wall 332 of the central convergence chamber 324 and through a flanged pillow block 333. The planar diverting gate 330 is actuated by pneumatic cylinder 334 pivotally linked to the gate pin 331 through cylinder rod clevis and crank arm 335.

In the embodiment shown in the FIGS. 3, 6 and 13, the pneumatic cylinder 334 for the planar gate 330 is rotatably fixed to a cylinder clevis 336 mounted on cylinder standoff with clevis bracket 337. The planar gate 330 may also be provided with cutting edges or similar means to cut or shear product remaining in either transmission passage 308 or 310, or may be modified in configuration for the same purpose.

Figure 17:
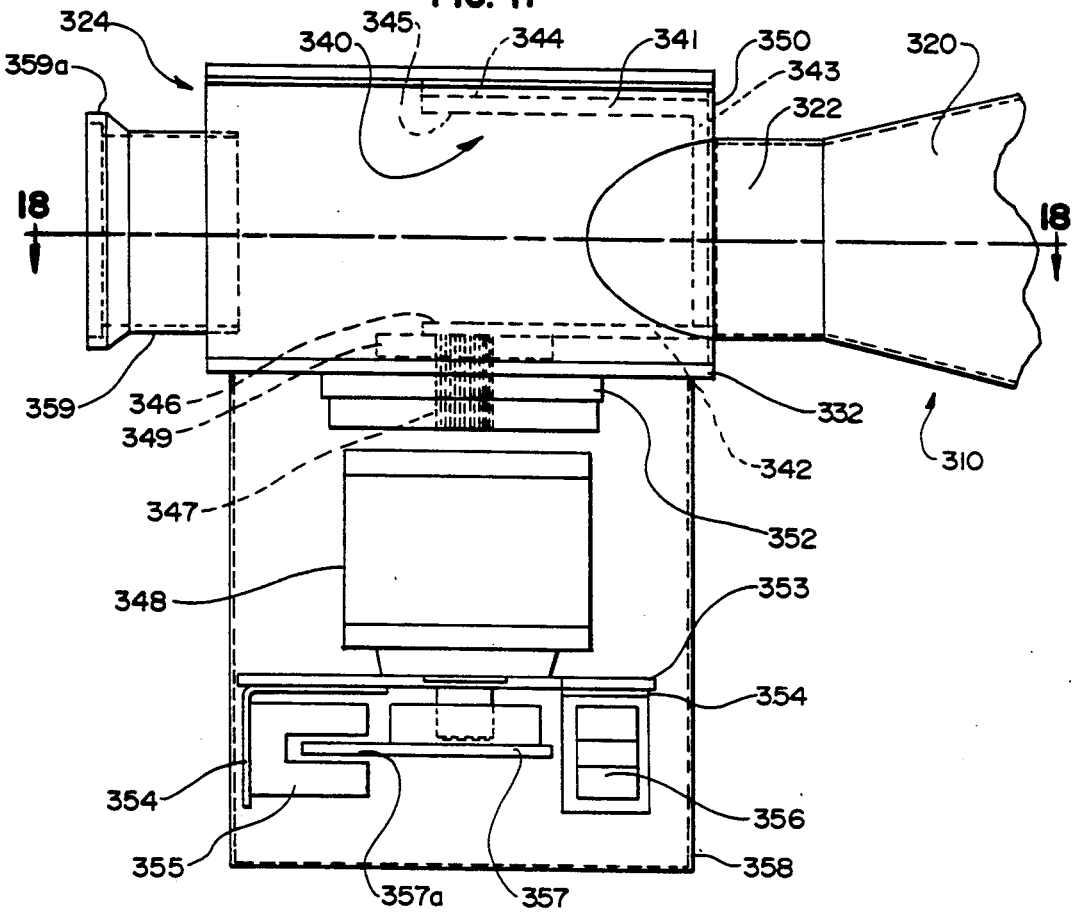
FIG. 17 is a fragmentary sectional elevation view of the transmission passages and the consolidating feed manifold having the crescent diverting gate mechanism shown in FIG. 1.
Figure 18:
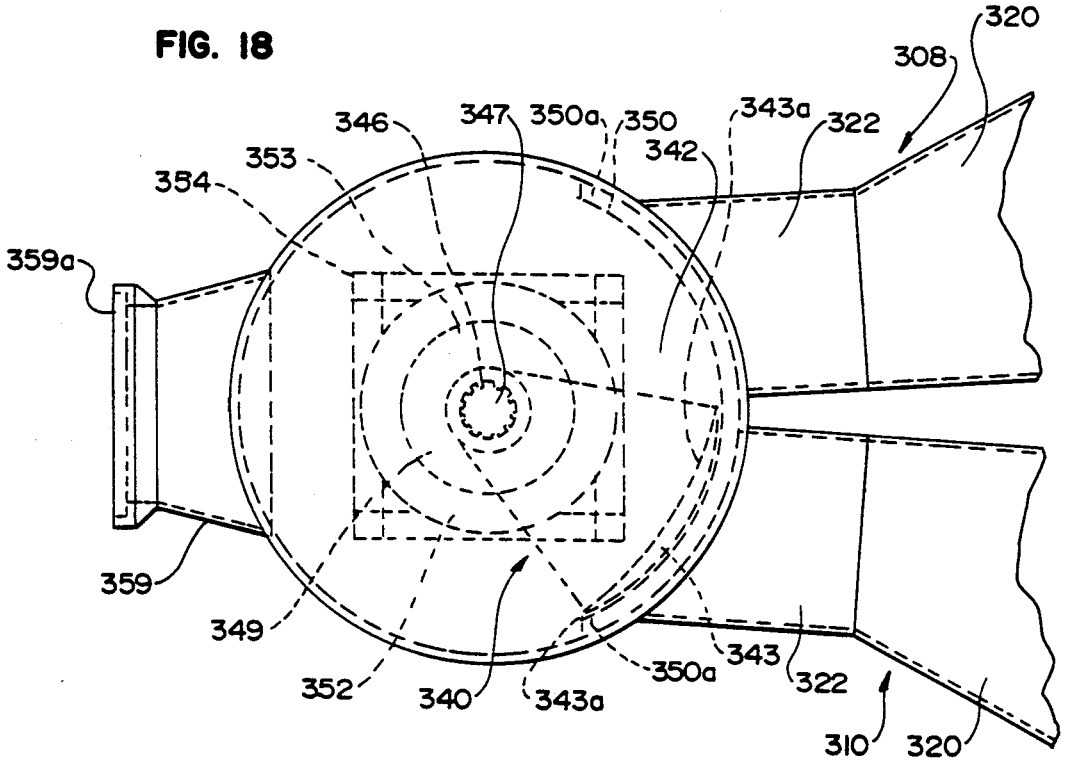
FIG. 18 is a fragmentary top sectional view of the transmission passages and consolidating feed manifold having the crescent diverting gate mechanism shown in FIG. 1 taken along lines 18—18 of FIG. 17.

As shown in FIGS. 1, 17 and 18, the preferred embodiment of the diverting gate is the crescent gate 340 which also pivots within the convergence chamber 324 to alternately close the transmission chambers 308 and 310. The crescent gate 340 comprises a first, horizontally disposed triangular upper arm 341; a second horizontally disposed triangular lower arm 342, spaced from the first arm 341; and a curved gate wall 343 connecting the peripheral, radial edges of the upper arm 341 and lower arm 342.

In this embodiment, the inner surface of the cover 326 of the convergence chamber 324 is provided with a subtending boss 344. A sleeve bearing of ultra high molecular weight polyethylene or other suitable materials is mounted on the boss 344. An opening 345 is formed with the upper arm 341 of the crescent gate 340 for receiving the boss 344 to form an upper pivot for the crescent gate 340.

A corresponding opening 346 is formed in the lower arm 342 of the crescent gate 340, opposite the upper pivot point, to receive a splined shaft 347 of a gate rotary actuator 348 extending through the bottom wall 332 of the convergence chamber 324. As shown in FIG. 18, the opening 346 of the lower arm is provided with teeth to engage the splined shaft 347 and to ensure efficient transfer of the rotational drive from the gate rotary actuator 348 to the crescent gate 340. An O-ring 349 of ultra high molecular weight polyethylene or similar materials, is interposed as a bearing member between the lower arm 342 and the bottom 332 of the convergence chamber 324. This O-ring 349 facilitates the movement of the crescent gate 340, and seals the convergence chamber 324 from leaks or seepage.

The curved gate wall 343 is configured to correspond to the curvature and dimension of the side wall of the convergence chamber 324. The curved gate wall 343 is also configured to ensure that the gate wall 343 blocks and closes one of the two transmission passages 308 or 310 when the gate wall 343 is positioned at the opening of those passages. The exposed peripheral edges 343*a* of the curved gate wall 343 are preferably sharpened to knife-like edges to shear away any product or portions of product extending from the transmission passages 308 and 310 partially into the convergence chamber 324.

An additional gate bearing plate 350 may also be employed to further ensure a proper seal between the curved gate wall 343 and the transmission passages 308 and 310. This gate bearing plate 350 preferably extends a sufficient distance around the circumference of the convergence chamber 324 to surround the openings of the transmission passages 308 and 310, and extends a distance beyond both of those openings. The convergence chamber 324 may also be provided with pins 350*a* positioned on either side of the bearing plate 350. These pins 350*a* stop excess rotation of the crescent gate 340 within the convergence chambers 324.

As shown in FIGS. 17 and 18, the rotary actuator 348 is mounted to the exterior of the convergence chamber bottom wall 332 by a mounting block 351 affixed to the bottom wall 332 and an intermediate mounting plate 352.

Attached to the opposite end of the rotary actuatory 348 is a position sensor mounting plate 353. Attached to this plate 353 by brackets 354 are gate position sensors 355 and 356. These sensors, like those of the pump cylinders mentioned above 214 and 216, are preferably U-shaped induction sensors adapted to receive the lobe portion 357*a* of actuating cam 357. This cam 357 is preferably mounted to the distal end of the rotary actuator shaft 347.

These gate position detectors 355 and 356 operate essentially in the same manner as the pump cylinder position detectors 216 and 216 discussed above. They control both the position and the movement of the gate rotary actuator to help ensure consistent and automated operation of the device.

The rotary actuator assembly is also enclosed within a drive cover 358, bolted to the convergence chamber bottom. This cover 358 is preferably provided with ports for the electrical and hydraulic lines (not shown) used to operate the rotary actuators 348 and position detectors 355 and 356.

As mentioned above, gates with other configuration and movement paths may also be used. Other gate actuator systems, such as hydraulic, rotary actuated or electromechanical drives may be used as well.

The product exits the convergence chamber 324 through discharge conduit 359 extending through the side wall of the convergence chamber 324. In the preferred embodiment, the discharge conduit 359 is located opposite the transmission passages 308 and 310, although it may be also disposed in other locations. The preferred discharge conduit 359 is also provided with sanitary ferrule 359*a* for engagement with downstream equipment.

Figure 14:
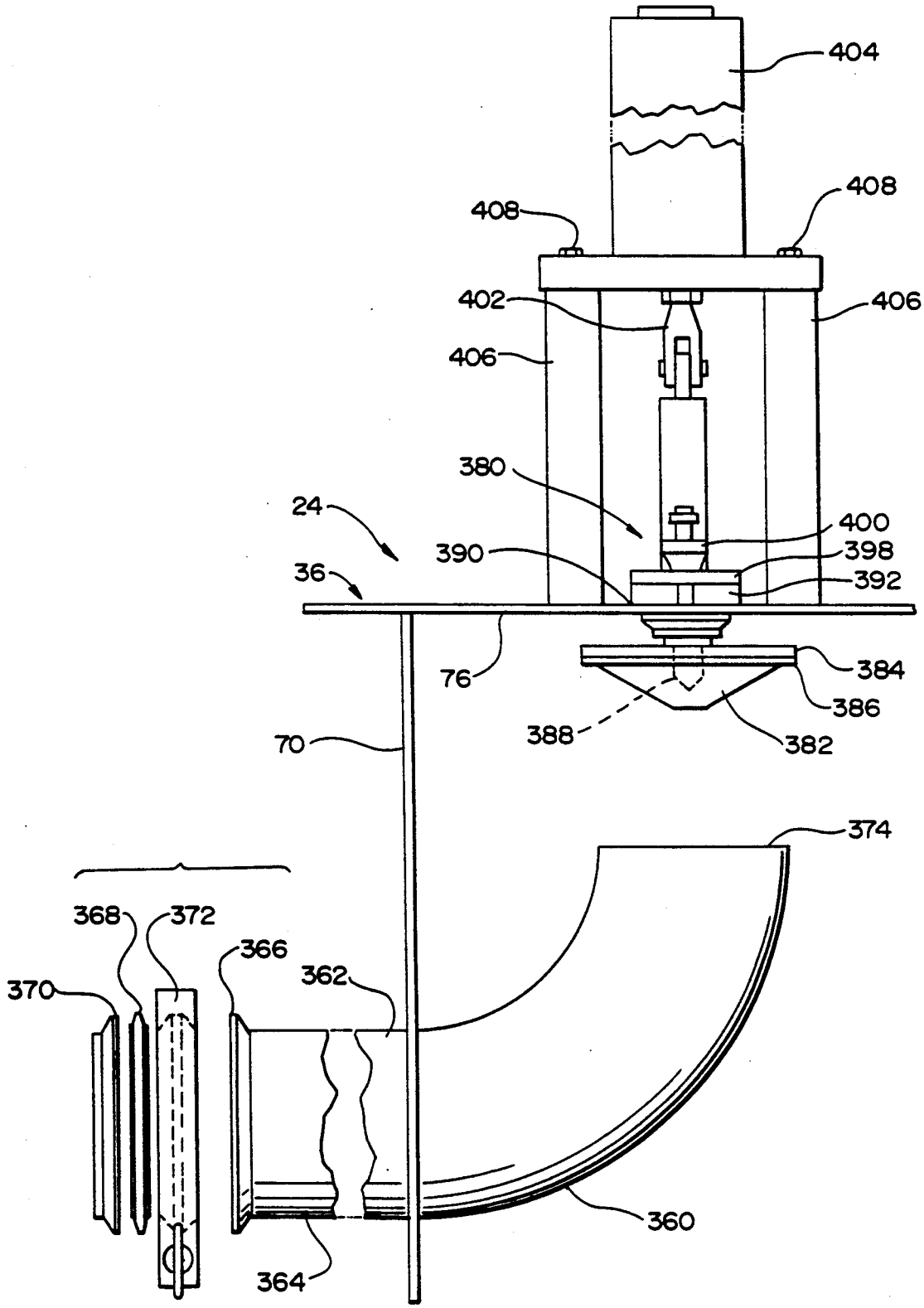
FIG. 14 is a fragmentary top plan view of the deaeration enhancing inlet valve taken along line 14—14 of FIG. 2.

As mentioned above, in one embodiment for a deaeration configuration, the device 10 may be provided with an optional deaeration enhancing inlet valve 24 ("DEIV") incorporated into a product supply passage as shown in FIGS. 2, 3 and 14. As shown in FIG. 14, the DEIV includes an elbow inlet conduit 360 extending through a port 362 in the hopper side wall 70 into the interior of the hopper 14. The port 362 is located at the upper level of the product contained within the hopper 14 when the device is in operation.

The exterior exposed end portion 364 of the elbow inlet conduit 360 is preferably attached to a sanitary ferrule 366 and furnished with a tube gasket 368 and short-weld ferrule 370 by clamp 372, for engagement with other processing equipment. The inlet conduit 360 is attached to the hopper side wall 70 positioning the elbow bend of the conduit 360 parallel to the hopper bottom 80, with the open end 374 of the conduit 360 within the hopper 14 directed toward the housing rear panel 36.

Poppet valve assembly 380 is positioned opposite the interior opening 374 of the conduit 360. The valve assembly 380 is provided with a disseminator poppet 382 mounted on poppet plate 384, with a poppet gasket 386 disposed between the poppet 382 and poppet plate 384. The poppet plate 384 is attached or threaded to reversably traveling poppet stem 388 extending through the poppet valve port 390 in the housing rear panel 36. The poppet stem 388 also passes through stem seal 392, with a sealing member (such as a rubber quad ring) and O-ring secured to the rear panel 36 by stem seal mounting plate 398 and knob nuts 400.

The exposed end of the poppet stem 388 is pivotally linked to the rod clevis 402 of pneumatic air cylinder 404, or other such drive means as mentioned above, mounted on standoff 406 by hex bolts 408. The pneumatic air cylinder 404 may be powered by sources internal to the device or by remote sources of pneumatic force.

In operation, the DEIV 24 acts to distribute and open pockets in product drawn or pumped into the hopper 14 by the vacuum within the hopper or by other means. The product passes through the inlet conduit 360 to contact the tapered poppet 382. On impact, the product is fragmented into smaller portions to expose the maximum surface area to the vacuum within the chamber for removing any trapped pockets within the product and then falls into the hopper. The poppet 382 may be selectively positioned relative to the open end 374 of the inlet conduit 360 by the pneumatic cylinder 404 to maximize the benefits of the DEIV valve 24.

As shown in FIGS. 1-3, the device housing 12 is further preferably mounted on wheeled members 410, including casters 412, to permit the convenient movement of the device 10 from place to place. The preferred embodiment, also may include an internal hydraulic fluid reservoir and hydraulic motor(s) (not shown) for use in connection with the above-mentioned hydraulic actuators 194 and 196 and hydraulic cylinders 230 and 232, and the agitator 16, mounted below the hopper 14 proximate and parallel to one of the housing side panels 30 or panel 32.

In operation, the product is either batch loaded into the device 10 through an open hatch 40, a hatchless embodiment for non-vacuum applications, or continuously pumped or drawn into the device through the sanitary inlet tube incorporating the DEIV 24 to a preferred level within the hopper 14. When an agitator 16 is used, particularly in deaerating applications, the product level is often allowed to fluctuate between the top of the agitator ribbon flighting 112 at the agitator shaft 110. The product is then slowly and gently stirred by the agitator 16, when an agitator 16 is utilized, to reduce air pockets, product clumps and to mix any additives or dissimilar materials into the product and to assist in breaking up the product to expose more surfaces to the deaerating vacuum in deaeration operations.

For deaerating configurations, and other configurations when necessary, sensing systems known to the art may be used to determine the amount of product supplied to the device 10, the product level and, in the deaerating applications, the negative pressure within the hopper 14. These sensing systems may be combined with control systems also known to the art to maintain the above conditions at the optimum levels.

The product may be agitated for a period of time for mixing, cooling, heating or other processing purposes. Alternatively, the pumping procedure may be initiated immediately. During the pumping procedure, the flighting and hoop members 112 and 114 of the agitator 16 generally direct the product towards the pump cylinders 18 and 20 where the product is urged by gravity flow and the movement of the agitator 16 into the piston chambers 128 and 130.

In normal operation, the rotatable inner sleeve 140 of the first pump cylinder 18 of the two synchronized pumps is disposed in an open position I with the inner sleeve longitudinal edges 146 in register with the longitudinal edges 120 of the sleeve housing 90 to permit product to pass into the piston chamber 128. At the same time, the second pump cylinder 20 is in a closed position II, with the second inner sleeve longitudinal edges 148 out of register with the longitudinal edges 122 of the second sleeve housing 92 so that the outer wall of the sleeve 142 prevents the movement of product into the piston chamber 130.

While the first piston chamber 128 is filling with food product, assisted by the agitator assembly 16, in one embodiment, the piston 230 of the first pump cylinder 18 is in a fully retracted position with the first piston plunger plate 238 proximate to the sleeve rear wall **140*b* and housing rear wall 90*b*. A predetermined period of time is allowed to ensure that the open piston chamber 128 is filled with product. Alternatively, it may be advisable in certain applications to employ sensors, such as those known in the art, to monitor the contents of the pump chamber 128 and to start the rotary actuator 194 when the product reaches a predetermined level within the pump chamber 128**.

When piston chamber 128 is filled, the rotary actuator 194 is activated to move the first rotatable sleeve 140 from its open in-register position I, to its closed out-of-register position II sealing the first piston chamber 128 from the interior of the hopper 14. When the first sleeve 140 is rotated, the sharpened sleeve edges 146 cooperate with the first sleeve housing edges 120 to shear away any product or pieces of product that are not completely within the pump chamber 128. As the sleeve edges 146 are angularly disposed relative to the longitudinal axis of the pump, this shearing action is gradually and progressively applied across the length of sleeve 140. Any sheared segments or pieces of product are redistributed by the agitator 16, if utilized, within the hopper to prevent an undesirable buildup in one location of such segments resulting in inconsistent finished product.

When the position detectors 210 sense that the first sleeve 140 is completely rotated to its closed position II, the hydraulic piston cylinder 270 is activated and the piston 230 is axially extended through the piston chamber 128. The piston plunger plate 238 forces the product out of the chamber 128 through the port 50 and into the first transmission passage 308 of the consolidating discharge manifold 22. Once the piston 230 reaches its full stroke, it is retracted to its original position and the rotary actuator 194 is activated to return the first sleeve 140 to its open position I.

To ensure a consistent synchronized pump action, the second pump cylinder 20 is activated once the position detector 210 senses that the first pump cylinder 18 is at, or approaching, the above-mentioned closed position II. At that time, the second rotatable sleeve 142 of the second pump cylinder 20 is moved from its closed position II to an open position I for receiving product within the pump chamber 130. The product advances into the second pump chamber 130 and the second pump cylinder 20 follows the same cycle, as described above, for the first pump cylinder 18.

The cycling of the two pump cylinders 18 and 20 are synchronized so that as one pump is closing and beginning to expel product from its piston chamber, the other pump is filling and preparing for the expulsion step. This provides a constant and steady supply of product to the consolidating manifold 22.

Once the product enters the consolidating manifold 22, it passes through transmission passages 308 and 310 and emerges into the central convergence chamber 324. As the product moves through the transmission passages 308 and 310, it pushes and urges forward any product already occupying the passages 308 and 310 into the convergence chamber 324 and out of the discharge conduit 359. From discharge conduit 359, the product may be dispensed into receptacles, conduits, casings or packaging equipment connected to the discharge conduit 359 at sanitary ferrule 359*a*.

During the operation of the consolidating manifold 22, the planar diverting gate 330, or the preferred crescent diverting gate 340, are positioned by their respective drive means to leave the first, cycling transmission passage 308 open, and to close the second, non-cycling passage 310 against backflow from the convergence chamber 324 and, when in a deaeration configuration, possible loss of negative air pressure from the hopper 14. The diverting gate such as planar gate 330 or, preferably crescent gate 340, is pivoted in the other direction to close the first transmission passage 308 and open the second passage 310 once the first pump cylinder 18 completes its pump cycle. The forward movement of the product through each transmission chamber 308 and 310 assists in the pivoting and sealing action of the gate during the pumping cycles.

The pumping cycles described above are continuously repeated until the hopper 14 is substantially empty or the pumping operation is complete. The synchronized action of the pump cylinders 18 and 20 permits the rapid and continuous supply of large or small volumes of product to appropriate casings or containers. The use of the agitator 16 and a gravity feed to fill piston chambers 128 and 130 also enables the invention to efficiently and economically receive, process and dispense products that include relatively large pieces, such as whole muscle meats and relatively delicate or easily damaged products, such as poultry breasts, that are easily damaged by other pumping devices.

The device 10 is easily disassembled for cleaning and sanitizing to satisfy industrial and governmental health standards. In the preferred embodiment, the rotatable sleeves 140 and 142 are removable for clearing and inspection, and are provided with a pair of opposed removal openings 430 located proximate to the open sleeve forward ends 140*a* and 142*a* to assist in the removal procedure.

Figure 15:
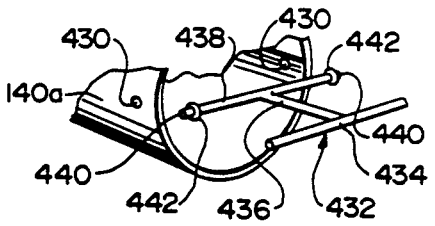
FIG. 15 is a fragmentary perspective view of the forward end of a rotatable sleeve such as shown in FIGS. 2 through 6 and a sleeve removal tool.
Figure 16:
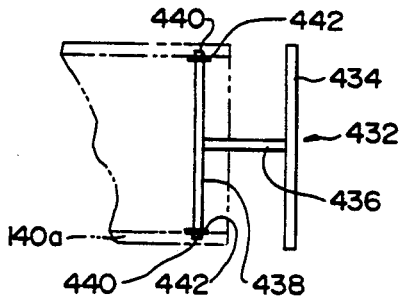
FIG. 16 is a fragmentary view of the sleeve and sleeve removal tool shown in FIG. 15 with the sleeve removal tool engaged.

To remove the rotatable sleeves 140 and 142, the manifold mounting plate 292 is pivoted away from the housing front panel 34 to expose the rotatable sleeve forward ends 140*a* and 142*a*. The retaining plate sleeves 258 and 260 are removed from the piston rods 234 and 236. As shown in FIGS. 15 and 16, a sleeve removal tool 432 may be inserted into each of the sleeves 140 and 142 to engage the removal openings 430 and the entire sleeves 140 and 142 with attached piston shafts 154 and 156 are pulled out of the cylindrical sleeve housings 90 and 92 of the device 10 along with the plunger plates 238 and 240 within the sleeves 140 and 142.

The sleeve removal tool 432 shown in FIGS. 15 and 16 includes handle 434, extension shaft 436 and removal crossbar 438 attached at its midpoint to the extension shaft 436. The ends 440 of the crossbar 438 are shaped to fit within and engage the sleeve removal openings 430. The crossbar ends 440 are provided with stop members 442, such as O-rings to prevent the ends 440 from contacting the interior of the sleeve housings 90 and 92.

While the invention has been described by reference to certain specific descriptions and examples which illustrate preferred materials, configurations and conditions, including those pertaining to the processing of food products, it is understood that the invention is not limited thereto. Rather, all alternatives, modifications and equivalents within the scope and spirit of the invention so described are considered to be within the scope of the appended claims.

What is claimed is:

1. A product pumping device comprising:

means for holding and supplying a volume of product;

displacement means in communication with said holding means operatively disposed to receive a predetermined quantity of said product from said holding means while in a receiving position and to advance said predetermined quantity of product to means for dispensing said product;

said displacement means including at least one interior cavity for receiving said predetermined quantity of product, said cavity having a central longitudinal axis, at least one outer sleeve means with at least one first access means extending therethrough and at least one inner sleeve means with at least one second access means extending therethrough, both of said sleeve means concentric about said central longitudinal axis of said cavity; and means for relatively rotating said outer and inner sleeve means about said central axis of said cavity to selectively position said first and second access means to allow communication between said interior cavity and said holding means.

2. The device of claim 1 wherein said sleeve means are provided with means for shearing and separating said pre-determined quantity of product from portions of said product remaining within said holding means when said access means are selectively positioned; said shearing means disposed along at least a portion of said access means of said sleeve means.

3. The device of claim 1 wherein said holding means is provided with means for agitating and dispersing said product within said holding means and for urging said product towards said displacement means.

4. The device of claim 1 wherein said product dispensing means comprise manifold means including at least one closable channel means in communication with said displacement means, means for closing said channel means, and discharge outlet means.

5. The device of claim 4 wherein said channel closing means comprise moveable gate means and means for alternately positioning said gate means in an open position and in a closed position; said positioning means synchronized with said displacement means to dispense a consolidated discharge of product.

6. The device of claim 1 wherein said holding means, displacement means and dispensing means are adapted for continuous processing of said product.

7. A product pumping device comprising:

means for holding and supplying a volume of product;

displacement means in communication with said holding means operatively disposed to receive a predetermined quantity of said product from said holding means while in a receiving position and to advance said predetermined quantity of product to means for dispensing said product;

said displacement means including at least one interior cavity for receiving said predetermined quantity of product, said cavity having a central longitudinal axis, at least one outer sleeve means with at least one first access means extending therethrough and at least one inner sleeve means with at least one second access means extending therethrough, both of said sleeve means concentric about said central longitudinal axis of said cavity; and means for selectively positioning said first and second access means to allow communication between said interior cavity and said holding means, wherein said holding means, displacement means and product dispensing means are adapted to deaerate said product.

8. The device of claim 7 wherein said holding means, displacement means and dispensing means are adapted for deaeration of said product under a reduced internal air pressure.

9. A product pumping device comprising:

hopper means for receiving and holding a volume of product;

displacement means in communication with said hopper means operatively disposed to receive a predetermined quantity of said product from said hopper means and to advance said predetermined quantity of product to means for dispensing said product;

said displacement means including at least two pump cylinder means, each said pump cylinder means having a central longitudinal axis;

each said pump cylinder means including an interior cavity for receiving said predetermined quantity of product, and at least one outer sleeve means with at least one first access means extending therethrough and at least one inner sleeve means with at least one second access means extending therethrough, both of said sleeve means concentric about said central longitudinal axis said pump cylinder means;

means for selectively positioning said first and second access means of each said pump cylinder means to allow communication between said interior cavities of each said pump cylinder means and said hopper means; and means for alternatingly ejecting said preselected product from said cavities of each of said pump cylinder means into said dispensing means, wherein said ejection means maintain a sealing engagement with said outer and inner sleeve means.

10. The device of claim 9 wherein said selective positioning means of each said pump cylinder means are synchronized to produce a consolidated discharge of product.

11. The device of claim 9 wherein said selective positioning means of each said pump cylinder means comprise means for relatively rotating said inner sleeve means about said central axis of said cylinder means; said rotating means of each said pump cylinder means synchronized to produce a consolidated discharge of product.

12. The device of claim 9 wherein said holding means are provided with means for agitating and dispersing said product within said holding means and for urging said product towards said displacement means.

13. The device of claim 12 wherein said agitating means is provided with a first section of helical ribbon flighting means and a second section of hoop and paddle means.

14. The device of claim 9 wherein said dispensing means comprise manifold means including closable channel means in communication with said pump cylinder means, means for closing said channel means and product outlet means.

15. The device of claim 14 wherein said manifold means include separate channel means in communication with each said pump cylinder means, gate means movable to alternately close said channel means, and means for positioning said gate means synchronized with said ejection means of said pump cylinder means to produce a consolidated discharge of product.

16. The device of claim 9 wherein said holding means, displacement means and dispensing means are adapted for continuous processing of product.

17. The device of claim 9 wherein said inner sleeve means are removable from said pump cylinder means.

18. The device of claim 9 wherein said dispensing means comprise manifold means including closable crescent gate means in communication with said pump cylinder means, means for closing said crescent gate means and product outlet means.

19. A product pumping device comprising:

hopper means for receiving and holding a volume of product;

displacement means in communication with said hopper means operatively disposed to receive a predetermined quantity of said product from said hopper means and to advance said predetermined quantity of product to means for dispensing said product;

said displacement means including at least two pump cylinder means, each said pump cylinder means having a central longitudinal axis;

each said pump cylinder means including an interior cavity for receiving said predetermined quantity of product, and at least one outer sleeve means with at least one first access means extending therethrough and at least one inner sleeve means with at least one second access means extending therethrough, both of said sleeve means concentric about said central longitudinal axis said pump cylinder means;

means for selectively positioning said first and second access means of each said pump cylinder means to allow communication between said interior cavities of each said pump cylinder means and said hopper means;

means for alternatingly ejecting said preselected product from said cavities of each of said pump cylinder means into said dispensing means, wherein said holding means, displacement means and product receiving means are adaptable to deaerate said product.

20. A product pumping device comprising:

hopper means for receiving and holding a volume of product;

displacement means in communication with said hopper means operatively disposed to receive a predetermined quantity of said product from said hopper means and to advance said predetermined quantity of product to means for dispensing said product;

said displacement means including at least two pump cylinder means, each said pump cylinder means having a central longitudinal axis;

each said pump cylinder means including an interior cavity for receiving said predetermined quantity of product, and at least one outer sleeve means with at least one first access means extending therethrough and at least one inner sleeve means with at least one second access means extending therethrough, both of said sleeve means concentric about said central longitudinal axis said pump cylinder means;

means for selectively positioning said first and second access means of each said pump cylinder means to allow communication between said interior cavities of each said pump cylinder means and said hopper means;

means for alternatingly ejecting said preselected product from said cavities of each of said pump cylinder means into said dispensing means;

wherein said holding means, displacement means, and dispensing means are adapted for deaeration under a reduced internal pressure.

21. A product pumping device comprising:

a hopper defining a hollow chamber for receiving a volume of product;

pump means for positively displacing said product from the interior of said hopper including at least one pump cylinder for receiving said product from said hopper, each of said pump cylinders having an interior cavity with a central longitudinal axis;

each said pump cylinder including an elongated cylindrical sleeve housing with a rearward end and a forward end, the exterior of said sleeve housing forming at least one first longitudinal opening disposed between said rearward and forward ends of said sleeve housing; and an elongated cylindrical sleeve disposed within said sleeve housing with a rearward end and a forward end, the exterior of said sleeve forming at least one second longitudinal opening disposed between said rearward and forward ends of said sleeve;

said sleeve reversibly rotatable about said central axis of said pump cylinder to an open position with said second longitudinal sleeve opening in register with said first longitudinal housing opening permitting the passage of product from said hopper into said pump cylinder cavity and to a closed position with said sleeve opening out of register with said first longitudinal housing opening preventing communication between said hopper and said pump cylinder cavity; and ejection means for displacing said products from each said pump cylinder cavity, said ejection means having a piston means disposed within each said pump cylinder cavity; said piston means including piston plate means and sealing engagement with said sleeve housing and said cylindrical sleeve of each said pump cylinder cavity.

22. The device of claim 21 wherein said pump means comprise a plurality of said pump cylinders, said ejection means of said pump cylinders synchronized to alternately displace product from each of said pump cylinder cavities producing a consolidated discharge of said product from said pump means.

23. The device of claim 21 wherein said device is provided with discharge manifold means in communication with said pump means, said discharge manifold means comprising a separate discharge passage in communication with each said pump cylinder to receive said product displaced from said pump cylinders, said discharge passages converging to form a central conduit for receiving and dispensing a consolidated discharge of product.

24. The device of claim 23 wherein said central conduit is provided with gate means alternately movable from a first open position to a second closed position to block the advancement of said product into said central conduit.

25. The device of claim 21 wherein said hopper is sealable for use in deaeration operations, said pump means are adapted for use in deaeration operations and said hopper is provided with deaeration enhancing inlet valve means.

26. The device of claim 21 wherein said hopper means and said pump means are adapted for continuous processing of product.

27. A product pumping device for easily damaged products comprising:

means for holding and supplying a volume of product;

displacement means in communication with said holding means operatively disposed to receive a predetermined quantity of said product from said holding means while in a receiving position and to advance said predetermined quantity of product to means for dispensing said product;

said displacement means including at least one interior cavity for receiving said predetermined quantity of product, said cavity having a central longitudinal axis, at least one outer sleeve means with at least one first access means extending therethrough and at least one inner sleeve means with at least one second access means extending therethrough, both of said sleeve means concentric about said central longitudinal axis of said cavity, said sleeve means provided with means for shearing and separating said predetermined volume of product from portions of said product remaining within said holding means when said access means are selectively positioned; said shearing means disposed along at least a portion of said access means of said sleeve means, said shearing means angularly disposed relative to said central longitudinal axis of said interior cavity; and means for selectively positioning said first and second access means to allow communication between said interior cavity and said holding means.

28. The device of claim 27 wherein said shearing means are disposed at an angle sufficient to progressively disperse said sheared portions of said product remaining within said holding means when said access means are selectively positioned.

29. A product pumping device comprising:

hopper means for receiving and holding a volume of product;

displacement means in communication with said hopper means operatively disposed to receive a predetermined quantity of said product from said hopper means and to advance said predetermined quantity of product to means for dispensing said product;

said displacement means including at least two pump cylinder means, each said pump cylinder means having a central longitudinal axis;

each said pump cylinder means including an interior cavity for receiving said predetermined quantity of product, and at least one outer sleeve means with at least one first access means extending therethrough and at least one inner sleeve means with at least one second access means extending therethrough, both of said sleeve means concentric about said central longitudinal axis said pump cylinder means, said sleeve means provided with means for separating said preselected quantity of product from said product retained in said hopper means when said access means are selectively positioned; said separating means comprising angularly disposed shearing means along at least a portion of said access means;

means for selectively positioning said first and second access means of each said pump cylinder means to allow communication between said interior cavities of each said pump cylinder means and said hopper means; and means for alternatingly ejecting said preselected product from said cavities of each of said pump cylinder means into said dispensing means, wherein said ejection means maintain a sealing engagement with said outer and inner sleeve means.

30. The device of claim 29 wherein said shearing means are disposed at an angle relative to said central longitudinal axis sufficient to progressively disperse said sheared portions of said product remaining within said holding means when said access means are selectively positioned.

31. A product pumping device comprising:

a hopper defining a hollow chamber for receiving a volume of product;

pump means for positively displacing said product from the interior of said hopper including at least one pump cylinder for receiving said product from said hopper, each of said pump cylinders having an interior cavity with a central longitudinal axis;

each said pump cylinder including an elongated cylindrical sleeve housing with a rearward end and a forward end, the exterior of said sleeve housing forming at least one first longitudinal opening disposed between said rearward and forward ends of said sleeve housing; and an elongated cylindrical sleeve disposed within said sleeve housing with a rearward end and a forward end, the exterior of said sleeve forming at least one second longitudinal opening disposed between said rearward and forward ends of said sleeve;

said sleeve reversibly rotatable about said central axis of said pump cylinder to an open position with said second longitudinal sleeve opening in register with said first longitudinal housing opening permitting the passage of product from said hopper into said pump cylinder cavity and to a closed position with said sleeve opening out of register with said first longitudinal housing opening preventing communication between said hopper and said pump cylinder cavity; and ejection means for displacing said products from each said pump cylinder cavity, said ejection means having a piston means disposed within each said pump cylinder cavity; said piston means including piston plate means and sealing engagement with said sleeve housing and said cylindrical sleeve of each said pump cylinder cavity, said piston plate means having a radially extending collar portion oriented to engage said sleeve housing through said second longitudinal opening in said cylindrical sleeve.

32. A product pumping device comprising:

a hopper defining a hollow chamber for receiving a volume of product;

pump means for positively displacing said product from the interior of said hopper including at least one pump cylinder for receiving said product from said hopper, each of said pump cylinders having an interior cavity with a central longitudinal axis;

each said pump cylinder including an elongated cylindrical sleeve housing with a rearward end and a forward end, the exterior of said sleeve housing forming at least one first longitudinal opening disposed between said rearward and forward ends of said sleeve housing; and an elongated cylindrical sleeve disposed within said sleeve housing with a rearward end and a forward end, the exterior of said sleeve forming at least one second longitudinal opening disposed between said rearward and forward ends of said sleeve;

said sleeve reversibly rotatable about said central axis of said pump cylinder to an open position with said second longitudinal sleeve opening in register with said first longitudinal housing opening permitting the passage of product from said hopper into said pump cylinder cavity and to a closed position with said sleeve opening out of register with said first longitudinal housing opening preventing communication between said hopper and said pump cylinder cavity; and ejection means for displacing said products from each said pump cylinder cavity, said ejection means having a piston means disposed within each said pump cylinder cavity; said piston means including piston plate means and sealing engagement with said sleeve housing and said cylindrical sleeve of each said pump cylinder cavity, said piston means axially movable through said interior cavities of said cylinders from said rearward end of said cylinders to said forward ends of said sleeves.

33. A product pumping device comprising:

a hopper defining a hollow chamber for receiving a volume of product, said hopper sealable and comprising a front wall, side walls, a rear wall and a curved bottom wall extending from said rear wall to an intermediate point between said front and rear walls; said front, back and side walls inclined toward said pump means, and said hopper front wall provided with pump ports positioned for the displacement of products from said pump means through said hopper front wall;

pump means for positively displacing said product from the interior of said hopper including at least one pump cylinder for receiving said product from said hopper, each of said pump cylinders having an interior cavity with a central longitudinal axis;

each said pump cylinder including an elongated cylindrical sleeve housing with a rearward end and a forward end, the exterior of said sleeve housing forming at least one first longitudinal opening disposed between said rearward and forward ends of said sleeve housing; and an elongated cylindrical sleeve disposed within said sleeve housing with a rearward end and a forward end, the exterior of said sleeve forming at least one second longitudinal opening disposed between said rearward and forward ends of said sleeve;

said sleeve reversibly rotatable about said central axis of said pump cylinder to an open position with said second longitudinal sleeve opening in register with said first longitudinal housing opening permitting the passage of product from said hopper into said pump cylinder cavity and to a closed position with said sleeve opening out of register with said first longitudinal housing opening preventing communication between said hopper and said pump cylinder cavity; and ejection means for displacing said products from each said pump cylinder cavity, said ejection means having a piston means disposed within each said pump cylinder cavity; said piston means including piston plate means and sealing engagement with said sleeve housing and said cylindrical sleeve of each said pump cylinder cavity.

34. The device of claim 33 wherein said pump cylinders are operatively disposed proximate to said hopper bottom wall between said intermediate point and said front wall, parallel to said hopper bottom wall, said pup cylinders in communication with said pump access ports in said hopper front wall.

35. The device of claim 34 wherein each of said sleeve housings include a rearward end proximate to said curved bottom wall and a forward end in communication with said pump ports, and each of said cylindrical sleeves disposed within said sleeve housings include a rearward end proximate to said hopper bottom wall and a forward end extending a predetermined distance into said pump ports.

* * * * *